US008744109B2

(12) United States Patent
Crooijmans

(10) Patent No.: US 8,744,109 B2
(45) Date of Patent: Jun. 3, 2014

(54) HIDDEN MICROPHONES FOR A MOBILE COMPUTING DEVICE

(75) Inventor: Wilhelmus Crooijmans, San Jose, CA (US)

(73) Assignee: QUALCOMM Incorporated, San Diego, CA (US)

( * ) Notice: Subject to any disclaimer, the term of this patent is extended or adjusted under 35 U.S.C. 154(b) by 259 days.

(21) Appl. No.: 13/171,011

(22) Filed: Jun. 28, 2011

(65) Prior Publication Data

US 2012/0201409 A1 Aug. 9, 2012

Related U.S. Application Data

(60) Provisional application No. 61/440,840, filed on Feb. 8, 2011.

(51) Int. Cl.
*H04R 9/08* (2006.01)

(52) U.S. Cl.
USPC ..... 381/355; 381/322; 381/335

(58) Field of Classification Search
USPC ..... 381/306, 357, 333, 388, 94.1
See application file for complete search history.

(56) References Cited

U.S. PATENT DOCUMENTS

| | | | | |
|---|---|---|---|---|
| 5,473,702 | A * | 12/1995 | Yoshida et al. | 381/94.7 |
| 7,664,284 | B2 * | 2/2010 | Zhang et al. | 381/355 |
| 8,131,329 | B2 * | 3/2012 | Eaton | 455/575.4 |
| 8,155,364 | B2 * | 4/2012 | An et al. | 381/357 |
| 2009/0175466 | A1 * | 7/2009 | Elko et al. | 381/94.2 |

* cited by examiner

*Primary Examiner* — Davetta W Goins
*Assistant Examiner* — Amir Etesam
(74) *Attorney, Agent, or Firm* — Mahamedi Paradice Kreisman LLP

(57) ABSTRACT

A mobile computing device is disclosed. The mobile computing device comprises a first housing segment and a second housing segment that are slideably coupled to each other so that the mobile computing device can be in an extended position or a contracted position. The second housing segment includes a section that is overlaid by the first housing segment regardless of whether the mobile computing device is in the extended position or the contracted position. The mobile computing device also includes two microphones. A first microphone is provided with the second housing segment and is exposed to an opening of the second housing segment. A second microphone is provided at the overlaid section.

19 Claims, 3 Drawing Sheets

HIDDEN MICROPHONES FOR A MOBILE COMPUTING DEVICE

RELATED APPLICATIONS

This application claims the benefit of priority under 35 U.S.C. 119(e) to Provisional Application Ser. No. 61/440,840, filed Feb. 8, 2011, titled HIDDEN MICROPHONES FOR A MOBILE COMPUTING DEVICE, which is incorporated herein by reference in its entirety.

BACKGROUND OF THE INVENTION

A microphone is a type of transducer. It is used to convert acoustic energy (e.g., sound) into electrical signals. To enable a microphone to work efficiently, sound waves must be able to reach the microphone. In mobile computing devices that include a microphone, an opening or aperture in the housing is needed so that the microphone can register acoustic pressure.

However, having an opening or aperture in the housing of the mobile computing device may not be aesthetically pleasing. This can be more evident when a mobile computing device has more than one microphone so that multiple apertures may be needed.

BRIEF DESCRIPTION OF THE DRAWINGS

The disclosure herein is illustrated by way of example, and not by way of limitation, in the figures of the accompanying drawings and in which like reference numerals refer to similar elements, and in which.

DETAILED DESCRIPTION

Figures 1A, 1B:
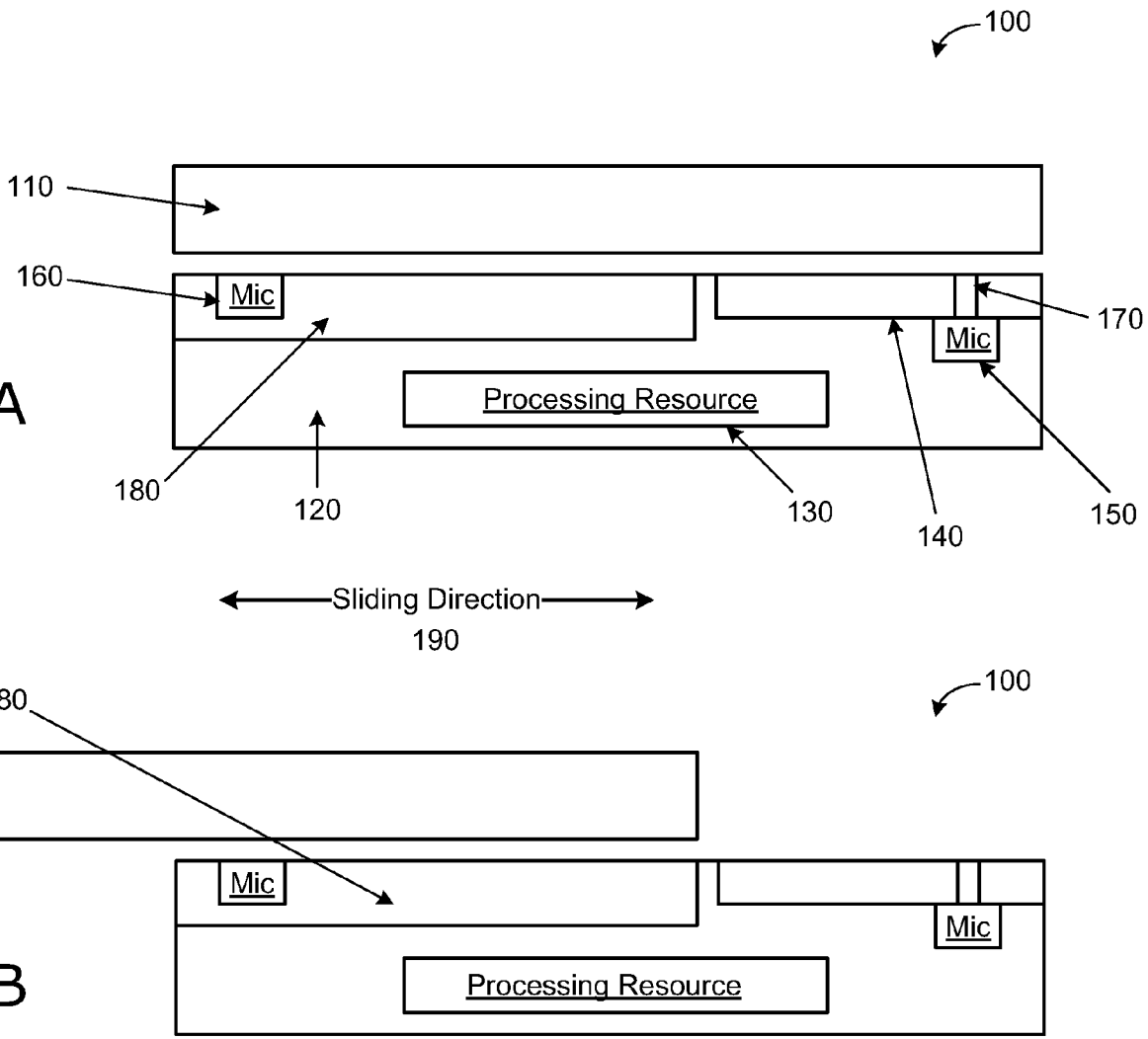
FIGS. 1A and 1B are illustrations of a mobile computing device that includes two microphones under an embodiment.

Embodiments described herein include a mobile computing device that integrates and conceals one or more microphones using inherent structural features of the device housing. In particular, embodiments incorporate two or mufti-microphone devices that utilize noise cancellation microphones. Such microphones can be displaced from the primary microphone which is oriented to be near where the user is expected to speak.

According to some embodiments, a mobile computing device incorporates a noise cancellation microphone (or other secondary microphone in a microphone pair) within an occluded region of a slider housing. The occluded region of the slider housing coincides with a region that is not exposed as a result of two housing segments overlaying one another in a sliding engagement.

Still further, according to some embodiments, the mobile computing device includes a first housing segment and a second housing segment. The second housing segment is slideably coupled to the first housing segment to move between an extended position and a contracted position. The second housing segment includes a section that is overlaid by the first housing segment regardless of whether the mobile computing device is in the extended position or the contracted position. The mobile computing device also comprises a first microphone and a second microphone. The first microphone is provided with the second housing segment and is exposed to an opening of the second housing segment. The second microphone is provided at the overlaid section.

In one embodiment, the mobile computing device also comprises a processing resource that is configured to receive a first signal from the first microphone and receive a second signal from the second microphone. By using the first and second signal, the processor resource can generate a noise reduced signal. In some embodiments, the processing resource can generate the noise reduced signal by at least subtracting the second signal from the first signal. The processing resource can also be provided with the second housing segment like the first microphone and the second microphone.

According to an embodiment, the opening is included in a front face of the second housing segment. The mobile computing device is oriented so that the front face of the second housing segment faces the first housing segment. In this manner, the front face of the second housing segment is overlapped by the first housing segment when the mobile computing device is in the contracted position. When the mobile computing device is in the extended position, at least a portion of the face of the second housing segment will be exposed. The first microphone that is exposed to the opening of the second housing segment can be positioned to face the opening.

In other embodiments, the second microphone that is provided at the overlaid section is positioned to face the same direction as the first microphone so that both microphones can face toward the first housing segment. The first microphone and the second microphone can also be positioned to be approximately equidistant from the processing resource.

In another embodiment, the mobile computing device can be configured so that various electrical components can be included in the two housing segments. The first housing segment can include a display screen and a speaker, while the second housing segment can include a processing resource and multiple microphones. The microphones can be positioned so that the opening of the second housing segment can be positioned to be closer to a user or speaker's mouth and the second microphone can be positioned to be further away from the speaker's mouth when the mobile computing device is being held up to the speaker's mouth and ear during a phone call.

Embodiments described herein also include a mobile computing device that includes a keyboard assembly. The keyboard assembly is provided with the second housing segment so that it is at least partially exposed when the mobile computing device is in an extended position and hidden when the mobile computing device is in a contracted position. The keyboard assembly can also include the opening of the second housing segment.

Some embodiments described herein may be implemented using programmatic elements, often referred to as modules or components, although other names may be used. Such programmatic elements may include a program, a subroutine, a portion of a program, or a software component or a hardware component capable of performing one or more stated tasks or functions. As used herein, a module or component, can exist on a hardware component independently of other modules/components or a module/component can be a shared element or process of other modules/components, programs or machines. A module or component may reside on one machine, such as on a client or on a server, or a module/component may be distributed amongst multiple machines, such as on multiple clients or server machines. Any system described may be implemented in whole or in part on a server, or as part of a network service. Alternatively, a system such as described herein may be implemented on a local computer or terminal, in whole or in part. In either case, implementation of system provided for in this application may require use of memory, processors and network resources, including data ports, and signal lines (optical, electrical etc.), unless stated otherwise.

Some embodiments described herein may generally require the use of computers, including processing and memory resources. For example, systems described herein may be implemented on a server or network service. Such servers may connect and be used by users over networks such as the Internet, or by a combination of networks, such as cellular networks and the Internet. Alternatively, one or more embodiments described herein may be implemented locally, in whole or in part, on computing machines such as desktops, cellular phones, personal digital assistances, laptop computers, or other computing devices. Thus, memory, processing and network resources may all be used in connection with the establishment, use or performance of any embodiment described herein (including with the performance of any method or with the implementation of any system).

Furthermore, some embodiments described herein may be implemented through the use of instructions that are executable by one or more processors. These instructions may be carried on a computer-readable medium. Machines shown in figures below provide examples of processing resources and computer-readable mediums on which instructions for implementing embodiments of the invention can be carried and/or executed. In particular, the numerous machines shown with embodiments of the invention include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on many cell phones and personal digital assistants (PDAs)), and magnetic memory. Computers, terminals, network enabled devices (e.g. mobile devices such as cell phones or tablet devices) are all examples of machines and devices that utilize processors, memory, and instructions stored on computer-readable mediums.

OVERVIEW

FIGS. 1A and 1B are illustrations of a mobile computing device that includes a mufti-microphone arrangement, with one microphone hidden, under an embodiment. More specifically, FIGS. 1A and 1B illustrate a mobile computing device 100 that includes two microphones, with at least one microphone that is hidden, concealed or otherwise obscured from plain sight, so that an opening or aperture for that microphone is not included in the housing of the mobile computing device 100. In an embodiment shown, a small inherent gap in the housing is used to conceal a secondary microphone that does not need to be near the expected source of the user's voice.

As examples, the mobile computing device 100 may correspond to any device that includes roaming wireless network and/or telephony capabilities, including cellular telephony devices and/or mobile messengers. In particular, embodiments described herein may apply to numerous kinds of mobile or small form-factor computing devices. One type of mobile computing device that may be configured to include embodiments described herein includes a computer telephony device, such as a cellular phone or mobile device with voice-telephony applications (sometimes called "smart phone"). A computing device such as described may be small enough to fit in one hand, while providing cellular telephony features in combination with other applications, such as messaging, web browsing, media playback, personal information management (e.g. such as contact records management, calendar applications, tasks lists), image or video/media capture and other functionality. Mobile computing devices in particular may have numerous types of input mechanisms and user-interface features, such as keyboards or keypads, mufti-directional or navigation buttons, application or action buttons, and contact or touch-sensitive display screens. Some devices may include combinations of keyboard, button panel area, and display screen on one façade. The button panel region may occupy a band between the keypad and the display area, and include a navigation button and multiple application buttons or action buttons.

Specific types of messaging that may be performed include messaging for email applications, Short Message Service (SMS) messages, Multimedia Message Service (MMS) messages, and proprietary voice exchange applications (such as SKYPE). Still further, other types of computing devices contemplated with embodiments described herein include laptop or notebook computers, ultra-mobile computers, personal digital assistants, and other multi-functional computing devices or mobile/portable devices.

Still further, one or more embodiments may be implemented through any type of computing device such as a desktop computer that is configured to include real-time voice data exchange (e.g. through use of Internet Protocol telephony). Still further, other types of computer telephony devices exist, including standalone devices that connect directly to a telephone network (whether Internet Protocol or Public Switch Telephony System (PSTN)) and provide software interfaces and applications.

The mobile computing device 100 comprises a first housing segment 110 and a second housing segment 120. The two housing segments are slideably coupled together so that they may move about each other in the sliding direction 190. FIG. 1A illustrates the mobile computing device 100 in a contracted position (e.g., where the two housing segments are lined up together) and FIG. 1B illustrates the mobile computing device 100 in an extended position. In one embodiment, the two housing segments can have the same width and/or thickness. In other embodiments, the two housing segments can be different sizes (e.g., the first housing segment 110 can be thinner than the second housing segment 120 or vice versa).

The first housing segment 110 and the second housing segment 120 can include various electrical components. In one embodiment, the first housing segment 110 can include a touch screen display and a speaker, for example. The second housing segment 120 can include a processing resource 130, a keyboard assembly 140, a first microphone 150 and a second microphone 160. The housing segments can include other electrical components such as a display, buttons, audio components, network and radio resources, memory, battery source, and other components, but are not illustrated in FIGS. 1A and 1B for simplicity. Depending on the design of the mobile computing device 100, different electrical components can be contained in different housing segments.

The mobile computing device 100 comprises two microphones. According to an embodiment, by using two microphones, the mobile computing device 100 can perform noise cancellation, and produce a better audio signal when the mobile computing device is being used during a phone call. The first microphone 150 can be used as a primary microphone in order to receive the sound from a user or speaker.

The first microphone 150 will receive the sounds coming from the user or speaker as well as background noise or other unwanted sounds (e.g., noise or sounds from the environment around the user or speaker). The second microphone 160 is positioned to be a distance away from the first microphone 150 and will also receive similar background noise or other unwanted sounds during a phone call. In other embodiments, multiple microphones can be used to enhance either the sounds coming from the user or speaker, or to enhance the noise cancellation functionality (e.g., more than two microphones).

In response to receiving the sounds coming from the user or speaker and/or the background noise, the first microphone 150 will produce a first signal and the second microphone 160 will produce a second signal. In some embodiments, the processing resource 130 receives the first signal and the second signal and generates a noise-reduced signal. Because the first signal corresponds mostly to the sounds of the user or speaker's voice and the second signal corresponds mostly to the background noise or other unwanted sounds, the processing resource 130 can generate the noise-reduced signal by subtracting the second signal from the first signal. The noise-reduced signal can be forwarded to a radio transceiver or component for exchanging with another cell phone during the length of a phone call.

Because the first microphone 150 is used as the primary microphone in one or more embodiments, the second housing segment 120 includes an opening or aperture 170 that can be aligned with the first microphone 150. A microphone is typically found within the housing of a mobile device. Because a microphone needs to be able to register acoustic pressure from sound waves in order to transmit an audio signal, an opening or aperture in the housing can assist or enable the microphone to function efficiently and properly.

The opening or aperture 170 can be aligned with the first microphone 150 so that the first microphone 150 is exposed to the opening 170. In some embodiments, the mobile computing device 100 is designed so that the first microphone 150 (and the opening 170) can be positioned closer to a user or speaker's mouth than the second microphone 160 during a phone call. For example, when the user holds the mobile computing device 100 to her head during a phone call, the first microphone 150 (and the opening 170) will be close to the user's mouth while the second microphone 150 is further away. This enables the first microphone 150 to better receive sound waves and in turn, provide better audio signals to the mobile computing device 100 (e.g., improve the signal-to-noise ratio).

The opening or aperture 170 can be provided in different locations of the second housing segment 120. In some embodiments, the opening 170 can be included in the front face of the second housing segment 120. The front face of the second housing segment 120 is the face that faces the first housing segment 110. In other embodiments, the opening 170 can be on the opposite face of the second housing segment 120 or on the sides or bottom.

The second housing segment 120 can also include a section 180 that is overlaid by the first housing segment 110. As illustrated in FIGS. 1A and 1B, the section 180 is overlaid by the first housing segment 110 when the mobile computing device 100 is in the contracted or extended position. In some embodiments, the second microphone 160 can be provided at the section 180. Because the section 180 is overlaid regardless of whether the mobile computing device 100 is in the contracted or extended position, the second microphone 160 will not be visible. The second microphone 160 can be partially or fully exposed (e.g., not fully covered by the housing of the second housing segment 160), but will be hidden underneath the first housing segment 110. Because the second microphone 160 is partially or fully exposed from the housing, no extra opening or aperture is needed. Due to the small gap between the two housing segments, the second microphone 160 can register acoustic pressure from sound waves in order to transmit an audio signal to the processing resource 130 of the mobile computing device. Similarly, in multi-microphone devices, multiple microphones may be positioned at the section 180 so that the microphones are not visible.

In some embodiments, the second microphone 160 can be positioned so that its detecting side (e.g., the side of the microphone that should face a sound source for receiving the most sound waves) faces toward the first housing segment 110. The second microphone 160 can be positioned in the same direction or orientation as the first microphone 150. In other embodiments, the second microphone 160 can be positioned so that its detecting side faces up, down or to the sides of the second housing segment 120. The two microphones can also be positioned a certain distance away from each other for optimum noise cancellation. In one embodiment, each microphone can be positioned approximately equidistant from the processing resource 130.

Because openings or apertures in the housing of a mobile computing device 100 are not necessarily aesthetically pleasing, the openings or apertures are designed to be very small (yet large enough to allow sound waves to pass through to a microphone). In one embodiment, the opening or aperture 170 for the first microphone 150 can be positioned in the second housing segment 120 so that it is harder for a user to see it. It can be positioned, for example, between a crack or a seam of two housing pieces that make up the second housing segment 120. In other embodiments, the opening 170 can be provided in the keyboard assembly 140 of the mobile computing device. Various other orientations, locations and positions for the opening or aperture 170 are possible.

In other embodiments, although not illustrated in FIG. 1A or 1B, the first microphone 150 can be provided with the second housing segment 120 while the second microphone 160 can be provided with the first housing segment 110. The second microphone 160 can be provided in a region of the first housing segment 110 that is not visible when the mobile computing device 100 is in either a contracted or extended position. Other variations include a first housing segment 110 that comprises a processing resource and keyboard assembly, and a second housing segment 110 that comprises a touch screen display. In some embodiments, multiple microphones may be positioned on either the first or second housing segments so that they are not visible when the mobile computing device 100 is in either the contracted or extended position.

Figure 2A:
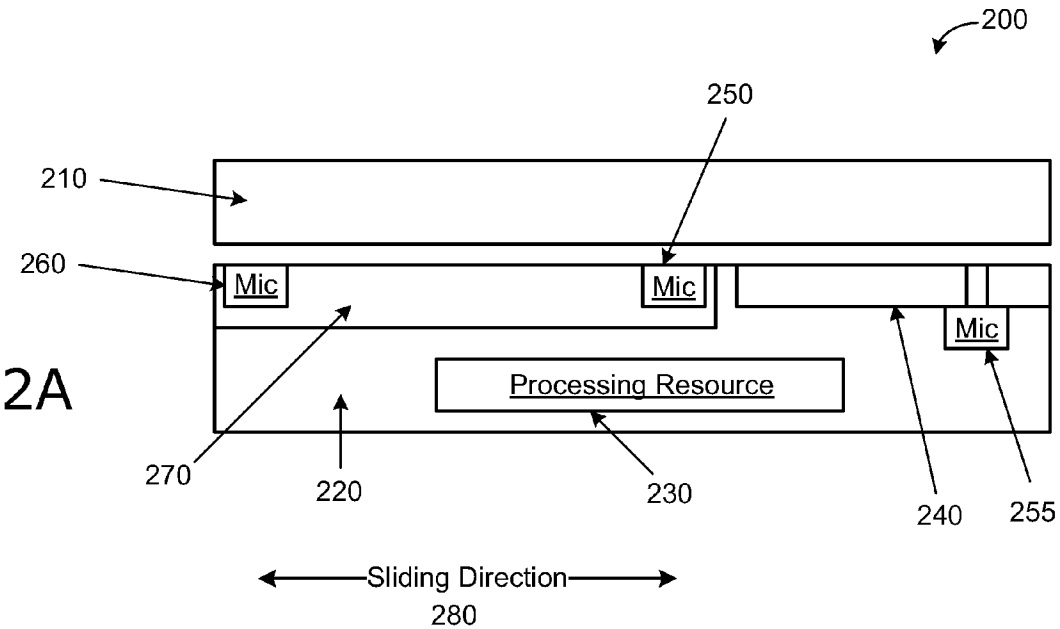
FIGS. 2A and 2B are illustrations of a mobile computing device that includes two microphones under another embodiment.
Figure 2B:
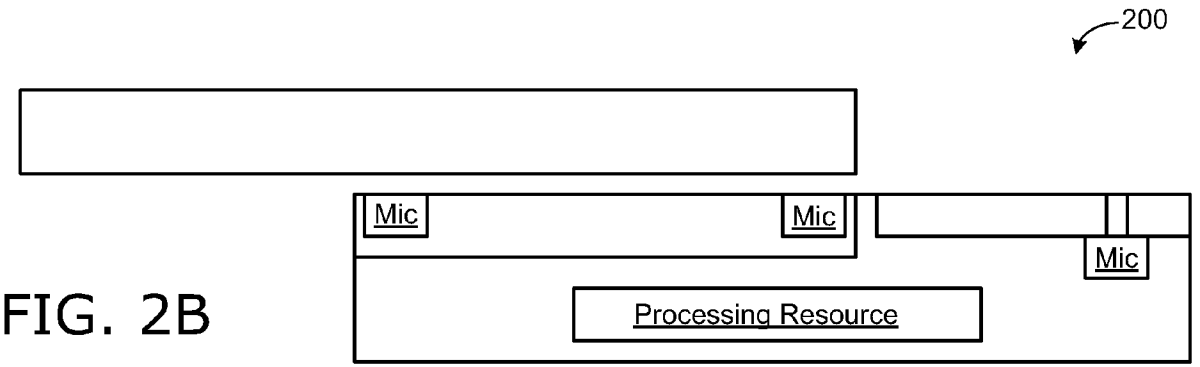

FIGS. 2A and 2B are illustrations of a mobile computing device that includes two microphones under another embodiment. Like the mobile computing device 100 in FIGS. 1A and 1B, the mobile computing device 200 also comprises a first housing segment 210 and a second housing segment 220. The housing segments are slideably coupled together so that they may move about each other in the sliding direction 280. FIG. 2A illustrates the mobile computing device 200 in a contracted position and FIG. 2B illustrates the mobile computing device 200 in an extended position. In some embodiments, the housing segments can have the same size and/or dimensions or different size and/or dimensions.

The housing segments of the mobile computing device 200 include a variety of different electrical components. In one embodiment, the second housing segment 220 comprises a processing resource 230, a keyboard assembly 240, a first microphone 255, a second microphone 250, and a third microphone 260. The second housing segment 220 also has a section 270 that is overlaid by the first housing segment 210 when the mobile computing device 200 is in the contracted or extended position. The housing segments can include other electrical components such as a display, buttons, audio components, network and radio resources, memory, battery source, and other components, but are not illustrated in FIGS. 2A and 2B for simplicity.

Like the mobile computing device 100 in FIGS. 1A and 1B, the mobile computing device 200 also comprises two microphones. However, in other embodiments, the mobile computing device 200 can include more than two microphones. In the illustration provided, the three microphones in the mobile computing device 200 can be used for noise cancellation so that a better audio signal can be produced when the mobile computing device 200 is being used for a phone call. The first microphone 255 can be used as a primary microphone that receives mostly the sounds coming from a user or speaker. The second and third microphones 250, 260 are used for noise cancellation. The second and third microphones can be positioned a certain distance away from each other for optimizing noise cancellation, and can be positioned a certain distance away from the first microphone 255 for optimizing noise cancellation.

In some embodiments, the processing resource 230 receives a first signal, a second signal, and a third signal from the first, second, and third microphones 255, 250, 260, respectively. Using these signals, the processing resource 230 can generate a noise-reduced signal. The noise-reduced signal can be forwarded to a radio transceiver or component for exchanging with another cell phone during the length of a phone call.

According to some embodiments, the mobile computing device 200 has an openings or apertures for exposing the first microphone 255. However, because the section 270 is overlaid by the first housing segment 210, the second and third microphones 250, 260 are not visible regardless of whether the mobile computing device 200 is in an extended or contracted position. The second microphone 250 and the third microphone 260 can be partially or fully exposed (e.g., not fully covered by the housing of the second housing segment 220) so that sound waves can reach the microphones. However, the second and third microphones 250, 260 will not be visible, but hidden underneath the first housing segment 210.

Figure 3:
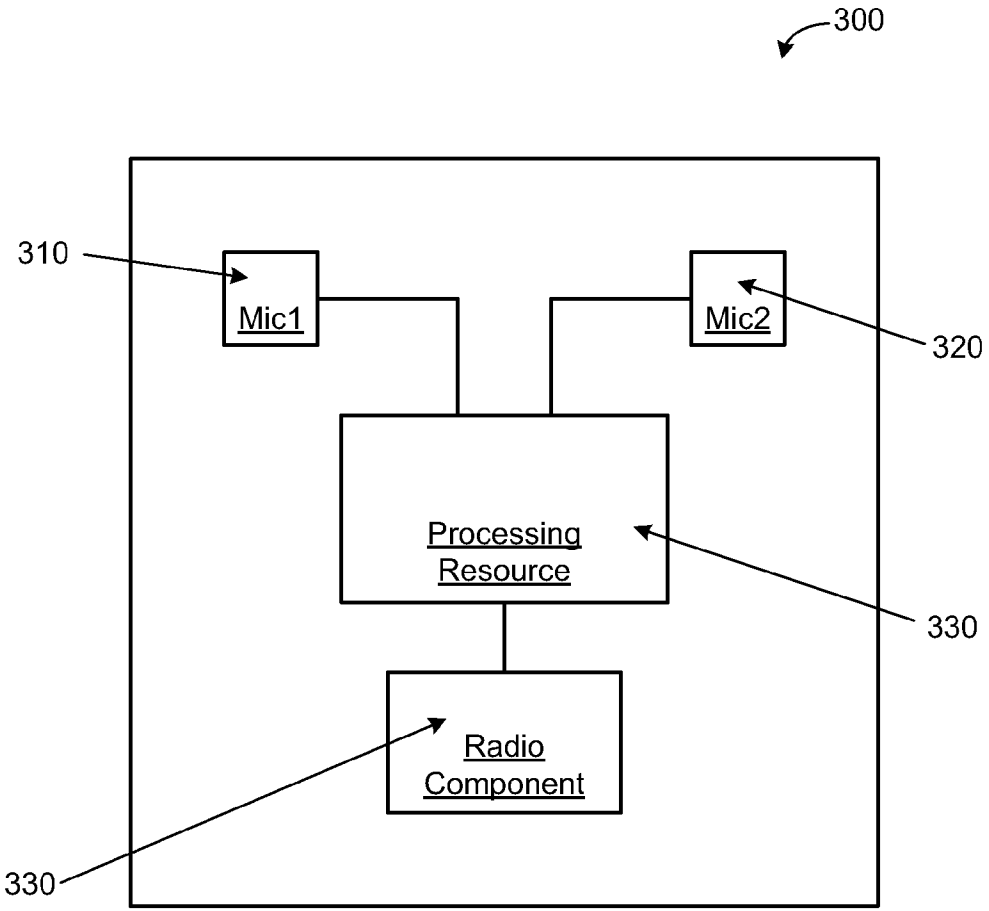
FIG. 3 illustrates a hardware diagram for a mobile computing device that is configured to support any of the embodiments described herein.

FIG. 3 illustrates a hardware diagram for a mobile computing device that is configured to support any of the embodiments described herein. An embodiment of FIG. 3 is depicted as a mobile computing device 300. The mobile computing device 300 comprises a first microphone 310, a second microphone 320, a processing resource 330 and a transceiver 340. The transceiver 340 can be a radio component that can communicate with a cellular network. In other embodiments, the mobile computing device 300 can include more than two microphones, so that two microphones can be used for primarily receiving sound from a user or speaker, and/or two microphones can be used for primarily receiving background noise.

According to one or more embodiments, the first microphone 310 and the second microphone 320 can be used for noise cancellation methods. The first microphone 310 can produce a first signal in response to receiving sound waves. The first microphone 310 can be the primary microphone for receiving sound from a user or speaker during a phone call. The second microphone 320 can produce a second signal in response to receiving sound waves from background noise or unwanted sounds. The processing resource 330 receives the first signal and the second signal and generates a noise-reduced signal. Because the first signal corresponds mostly to the sounds of the user or speaker's voice and the second signal corresponds mostly to the background noise or other unwanted sounds, the processing resource 330 can generate the noise-reduced signal by subtracting the second signal from the first signal. The noise-reduced signal can be forwarded to a transceiver 340 (e.g., a radio component) for exchanging the noise-reduced signal with another cell phone during the length of a phone call.

As discussed, the one or both microphones 310, 320 can be provided on a housing segment so that it is hidden from view. The housing segment can include a section that is overlaid by the other housing segment regardless of whether the mobile computing device is in the extended or contracted position. One or both microphones 310, 320 can be provided at the section so that openings or apertures for exposing a microphone are not needed in the housing segments of the mobile computing device 300.

In some embodiments, a mobile computing device that is configured to support any of the embodiments described herein can comprise just one microphone. The mobile computing device can be designed so that there is no opening or aperture in the housing of the device for the microphone. Instead, the microphone can be provided at the section that is overlaid by the first housing segment so that it is hidden regardless of whether the mobile computing device is in the extended or contracted position.

It is contemplated for embodiments described herein to extend to individual elements and concepts described herein, independently of other concepts, ideas or system, as well as for embodiments to include combinations of elements recited anywhere in this application. Although embodiments are described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations.

What is claimed is:

1. A mobile computing device comprising:

a first housing segment;

a second housing segment slideably coupled to the first housing segment to move between an extended position and a contracted position, the second housing segment having a front surface facing the first housing segment, wherein the front surface of the second housing segment includes a section overlaid by the first housing segment when the mobile computing device is in either the extended position or the contracted position;

a first microphone provided with the second housing segment and exposed to an opening of the second housing segment; and a second microphone provided on the front surface of the second housing segment at the section overlaid by the first housing segment to be concealed from view, wherein the second microphone is positioned at the section overlaid by the first housing segment so that no corresponding opening or aperture for the second microphone is provided on the first housing segment.

2. The mobile computing device of claim 1, further comprising a processing resource configured to (i) receive a first signal from the first microphone and a second signal from the second microphone, and (ii) generate a noise reduced signal.

3. The mobile computing device of claim 2, wherein the processing resource is provided with the second housing segment.

4. The mobile computing device of claim 3, wherein the processing resource generates the noise reduced signal by at least subtracting the second signal from the first signal.

5. The mobile computing device of claim 4, wherein the opening of the second housing segment is included in the front surface of the second housing segment.

6. The mobile computing device of claim 5, wherein the first microphone is positioned to face the opening of the second housing segment.

7. The mobile computing device of claim 5, wherein the first microphone and the second microphone are positioned to be approximately equidistant from the processing resource.

8. The mobile computing device of claim 5, wherein the opening of the second housing segment is positioned to be closer to a user's mouth and the second microphone is positioned to be further away from the user's mouth when the mobile computing device is held up to the user's mouth and ear during a phone call.

9. The mobile computing device of claim 1, further comprising a keyboard assembly that is (i) exposed when the mobile computing device is in the extended position, and (ii) hidden when the mobile computing device is in the contracted position.

10. The mobile computing device of claim 9, wherein the keyboard assembly includes the opening of the second housing segment, and wherein the first microphone is positioned to face the opening of the second housing segment.

11. The mobile computing device of claim 1, further comprising a speaker that is provided with the first housing segment.

12. A mobile computing device comprising:

a first housing segment;

a second housing segment slideably coupled to the first housing segment to move between an extended position and a contracted position, the second housing segment having a front surface facing the first housing segment, wherein the front surface of the second housing segment includes a section overlaid by the first housing segment when the mobile computing device is in the either extended position or the contracted position;

a first microphone provided with the second housing segment and exposed to an opening of the second housing segment;

a second microphone provided on the front surface of the second housing segment at the section overlaid by the first housing segment; and a third microphone also provided on the front surface of the second housing segment at the section overlaid by the first housing segment;

wherein the second microphone and the third microphone are positioned at the section overlaid by the first housing segment so that no corresponding openings or apertures for the second microphone or the third microphone are provided on the first housing segment.

13. The mobile computing device of claim 12, further comprising a processing resource configured to (i) receive a first signal from the first microphone, (ii) receive a second signal from the second microphone, (iii) receive a third signal from the third microphone, and (iv) generate a noise reduced signal.

14. The mobile computing device of claim 13, wherein the processing resource is provided with the second housing segment.

15. The mobile computing device of claim 12, wherein the opening of the second housing segment is included in the front surface of the second housing segment.

16. The mobile computing device of claim 12, wherein the opening of the second housing segment is positioned to be closer to a user's mouth and the second and third microphones are positioned to be further away from the user's mouth when the mobile computing device is held up to the user's mouth and ear during a phone call.

17. The mobile computing device of claim 12, further comprising a keyboard assembly that is (i) exposed when the mobile computing device is in the extended position, and (ii) hidden when the mobile computing device is in the contracted position.

18. The mobile computing device of claim 17, wherein the keyboard assembly includes the opening of the second housing segment, and wherein the first microphone is positioned to face the opening of the second housing segment.

19. The mobile computing device of claim 12, further comprising a speaker that is provided with the first housing segment.

* * * * *